US008460130B1

(12) United States Patent
Earle

(10) Patent No.: US 8,460,130 B1
(45) Date of Patent: Jun. 11, 2013

(54) FOOTBALL SNAP AID

(76) Inventor: James Earle, Florence, NJ (US)

( * ) Notice: Subject to any disclaimer, the term of this patent is extended or adjusted under 35 U.S.C. 154(b) by 205 days.

(21) Appl. No.: 13/114,069

(22) Filed: May 24, 2011

(51) Int. Cl.
*A63B 69/34* (2006.01)
*A63B 69/00* (2006.01)

(52) U.S. Cl.
USPC ..... 473/438; 473/441; 473/422

(58) Field of Classification Search
USPC ..... 473/422, 438, 441, 439, 446; 482/84; D21/720
See application file for complete search history.

(56) References Cited

U.S. PATENT DOCUMENTS 3,942,796 A * 3/1976 Bowen ..... 473/441
2006/0030434 A1* 2/2006 Horkan ..... 473/438
2006/0035733 A1* 2/2006 Silver et al. ..... 473/438

* cited by examiner

*Primary Examiner* — Mitra Aryanpour
(74) *Attorney, Agent, or Firm* — Kyle Fletcher

(57) ABSTRACT

The football snap aid simulates a snap of a football by a center to a quarterback located behind. The football snap aid includes an apparatus that supports a padded release lever from below, and which when engaged in an upward movement shall release a spring-loaded arm that supports a football on a cradle. The spring-loaded arm translates from a lowered position to a hiked position so as to simulate actual movement of the football during a snap. The football snap aid includes an upper handle and locking tab that can rotate to reset the spring-loaded arm between uses. The apparatus includes adjustable legs that can accommodate differently sized end user. The spring-loaded arm includes adjustment means to accommodate differently sized end users.

20 Claims, 7 Drawing Sheets

FOOTBALL SNAP AID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of football training devices, more specifically, an apparatus that simply and correctly snaps or centers a football to a person aside or behind said apparatus.

B. Discussion of the Prior Art

As will be discussed immediately below, no prior art discloses an apparatus that is used to simulate a snap of a football by a center; wherein the apparatus supports a padded release lever there under and when engaged by an upward movement shall release a spring-loaded arm that extends to support a football about a cradle from a lowered position to a hiked position whereby the person standing to the rear of the device shall grab said football from the cradle in order to simulate a football snap; wherein the apparatus includes a plurality of adjustable legs that can adjust to accommodate differently sized end users; wherein the spring-loaded arm includes an adjustment means that can also be adjusted to accommodate differently sized end users; and wherein an upper handle and locking tab are operated above said apparatus to reset the spring-loaded arm after use.

The Vaughn Patent (U.S. Pat. No. 4,906,001) discloses a football centering device that includes a cradle for a football at the end of a spring-loaded, pivotally mounted arm. However, the cradle does not translate from a prone position to a hiked ball, and resembles the same movement in actual play. Also, the device employs the use of a foot-operated pedal to release the spring-loaded arm as opposed to a padded release lever that upon upward impact releases the spring-loaded arm, and which resembles the kind of movement used in actual football play between the quarterback and the center.

The Stout et al. Patent (U.S. Pat. No. 6,050,906) discloses a mechanical football centering device for training quarterbacks to receive a snapped football. However, the device does not include a padded release lever that upon upward impact releases a spring-loaded arm that translates from a lowered to a hiked position and which is contained within a frame that takes the place of a center.

The Orner Patent (U.S. Pat. No. 6,575,852) discloses a portable apparatus for centering a football. However, the apparatus does not use a padded release lever that is suspended beneath a frame that shall resemble a center and upon upward movement releases a spring-loaded arm that translates the football from a lowered state to a hiked state as is usually performed by said center.

The Jurkiewicz et al. Patent (U.S. Pat. No. 3,399,892) discloses a mechanical football center training device. However, the training device does not include an apparatus that suspends a padded release lever under a frame and upon upward impact shall release a spring-loaded arm thereby translating a cradled football from a lowered position to a hiked position.

The Maxcey et al. Patent (U.S. Pat. No. 2,767,985) discloses a mechanical football center. Again, the device does not teach an apparatus that is adjustable in height and of which suspends a padded release lever that when impacted in an upward orientation shall release a spring-loaded arm that shall translate a cradled football from a lowered position to a hiked position.

The Mathis et al. Patent (U.S. Pat. No. 3,700,238) discloses a machine that is used for developing the proficiency of a quarterback and pass receivers in football. However, the machine is not a football hiking device that uses a padded release lever to simulate the interaction between a center and the quarterback.

The Warner Patent (U.S. Pat. No. Des. 422,028) illustrates an ornamental design for an athletic ball hunter, which does not depict the apparatus and padded release lever.

The Tucker Patent (U.S. Pat. No. 7,125,349) discloses a shotgun hiker that mechanically hikes a football. However, the shotgun hiker does not use an apparatus that suspends a padded release lever that upon upward impact shall release a spring-loaded arm that cradles a football from a lowered position to a hiked position.

The Quarterback Snap Machine, a non-patent piece of prior art, discloses a center machine that imitates the center quarterback exchange. However, the machine is not adjustable to accommodate different quarterback sizes as well as to translate the football from a lowered position to a hiked position.

While the above-described devices fulfill their respective and particular objects and requirements, they do not describe an apparatus that is used to simulate a snap of a football by a center; wherein the apparatus supports a padded release lever there under and when engaged by an upward movement shall release a spring-loaded arm that extends to support a football about a cradle from a lowered position to a hiked position whereby the person standing to the rear of the device shall grab said football from the cradle in order to simulate a football snap; wherein the apparatus includes a plurality of adjustable legs that can adjust to accommodate differently sized end users; wherein the spring-loaded arm includes an adjustment means that can also be adjusted to accommodate differently sized end users; and wherein an upper handle and locking tab are operated above said apparatus to reset the spring-loaded arm after use. In this regard, the football snap aid departs from the conventional concepts and designs of the prior art.

SUMMARY OF THE INVENTION

The football snap aid simulates a snap of a football by a center to a quarterback located behind. The football snap aid includes an apparatus that supports a padded release lever from below, and which when engaged in an upward movement shall release a spring-loaded arm that supports a football on a cradle. The spring-loaded arm translates from a lowered position to a hiked position so as to simulate actual movement of the football during a snap. The football snap aid includes an upper handle and locking tab that can rotate to reset the spring-loaded arm between uses. The apparatus includes adjustable legs that can accommodate differently sized end user. The spring-loaded arm includes adjustment means to accommodate differently sized end users.

It is an object of the invention to provide a device that simulates the movement of a football during a snap exchange between a center and quarterback.

A further object of the invention is to provide an apparatus that is simple to operate, and which is dependable in use to provide reliable simulation of the snap movement of a football.

A further object of the invention is to provide a spring-loaded arm that supports a football on a cradle.

An even further object of the invention is to provide a cradle that adequately secures the football to the spring-loaded arm, and which holds the football during the translational movement from the lowered position to the hiked position.

A further object of the invention is to provide an apparatus that includes adjustable legs and adjustment means on the spring-loaded arm so as to accommodate differently sized end users.

An even further object of the invention is to provide a device that is lightweight, yet of durable construction so as to withstand forces generated within the apparatus as well as forces imparted thereon during use.

A further object of the invention is to provide an upper handle that engages a locking tab from atop said apparatus, and wherein said upper handle when rotated forwardly shall extend tension cords, which provide the spring force on the spring-loaded arm.

These together with additional objects, features and advantages of the football snap aid will be readily apparent to those of ordinary skill in the art upon reading the following detailed description of presently preferred, but nonetheless illustrative, embodiments of the football snap aid when taken in conjunction with the accompanying drawings.

In this respect, before explaining the current embodiments of the football snap aid in detail, it is to be understood that the football snap aid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the football snap aid.

It is therefore important that the claims be regarded as including such equivalent construction insofar as they do not depart from the spirit and scope of the football snap aid. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
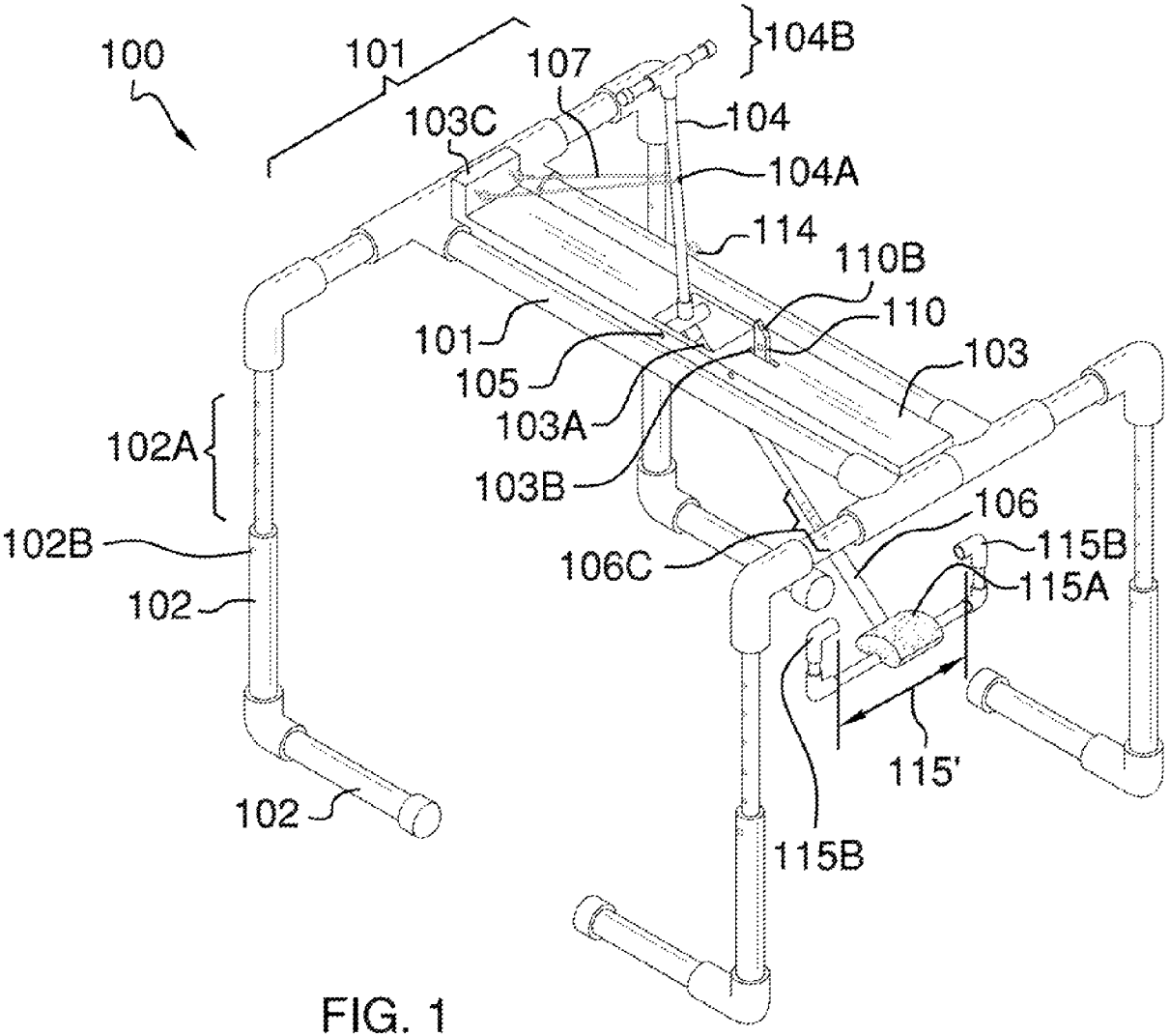
FIG. 1 illustrates a perspective view of the football snap aid by itself and with the upper handle rotated rearwardly in which case the tension cords are relaxed and the spring-loaded arm is in a hiked position.
Figure 2:
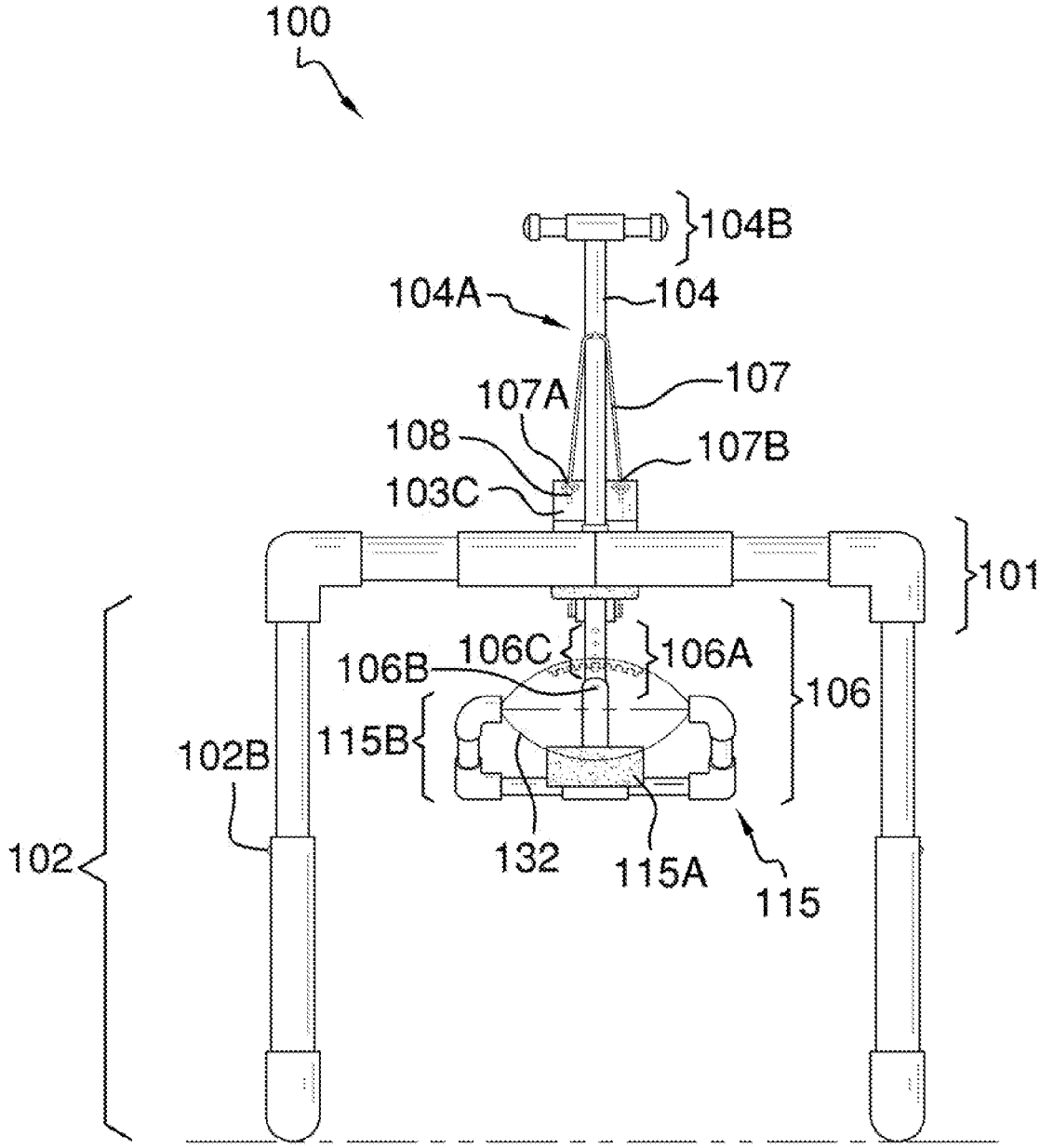
FIG. 2 illustrates a front view of the football snap aid in which cause the cradle of the spring-loaded arm is supporting a football thereon.
Figure 3:
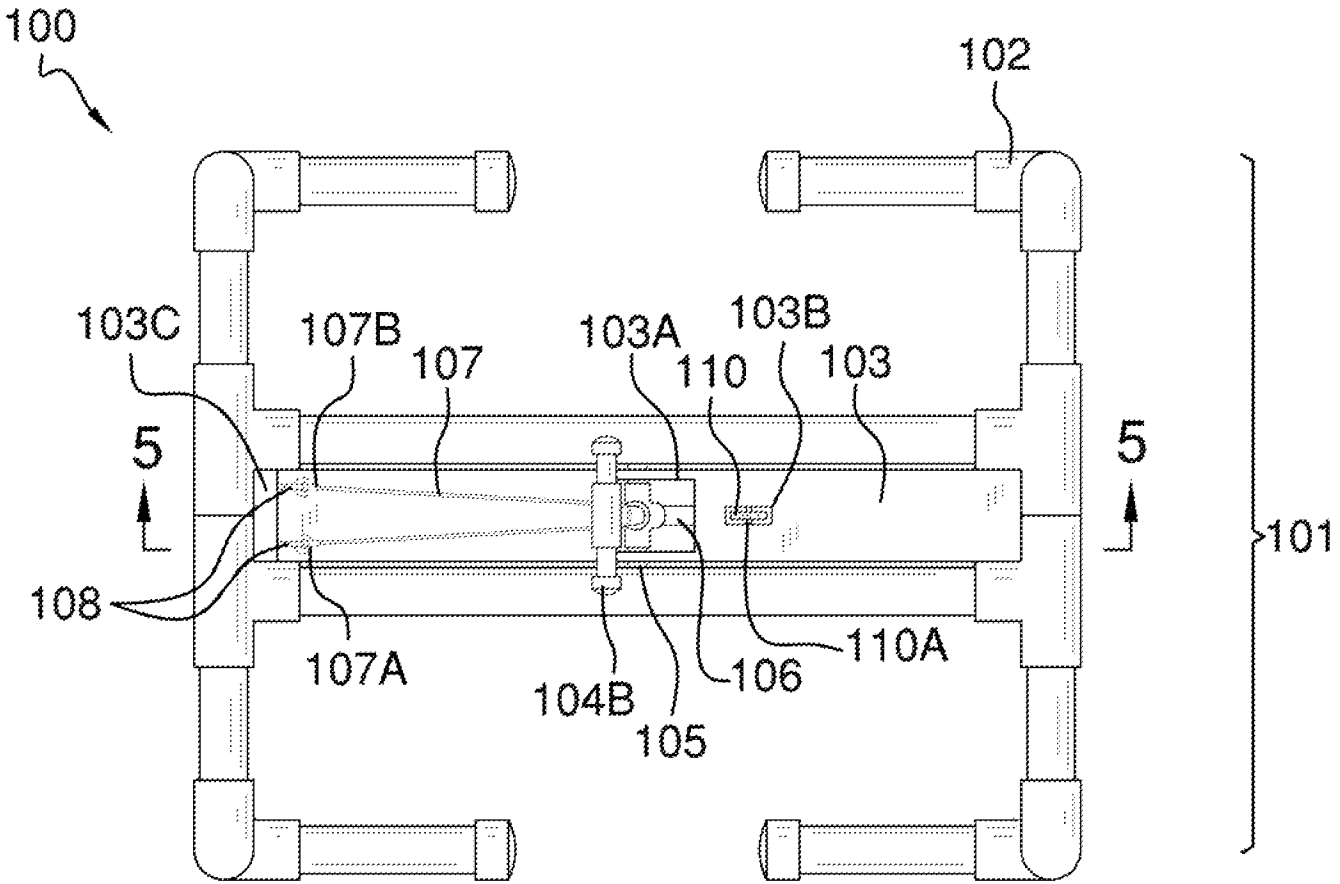
FIG. 3 illustrates a top view of the football snap aid, which details the opening in the apparatus through which the upper handle extends about a pivot point and wherein the spring-loaded arm is located.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A football snap aid 100 (hereinafter invention) includes an apparatus 101 from which a plurality of legs 102 extend downwardly. The apparatus 101 is further composed of a cross brace 103 upon which the invention 100 operates.

The cross brace 103 has a first opening 103A and a second opening 103B, which will be discussed further below. The invention 100 includes an upper handle 104 that rotates about a pivot point 105, which is located within the first opening 103A. The upper handle 104 attaches to a spring-loaded arm 106 that extends beneath the apparatus 101. More to the point, the spring-loaded arm 106 is an extension of the upper handle 104, and also rotates in concert with the upper handle 104. The spring-loaded arm 106 forms an angle 105' with respect to the upper handle 104 (see FIG. 5).

The cross brace 103 includes a lip 103C, which is located to a rear of the apparatus 101. The lip 103C forms an important function to the overall use of the invention 100 in that a first tension cord 107 applies tension onto the upper handle 104 The first tension cord 107 defined by a first end 107A attaches via an eyelet 108 to the lip 103C, thereafter wrapping around the upper handle 104 before tying a second end 107B via a second eyelet 108 to the lip 103C.

Figure 4B:
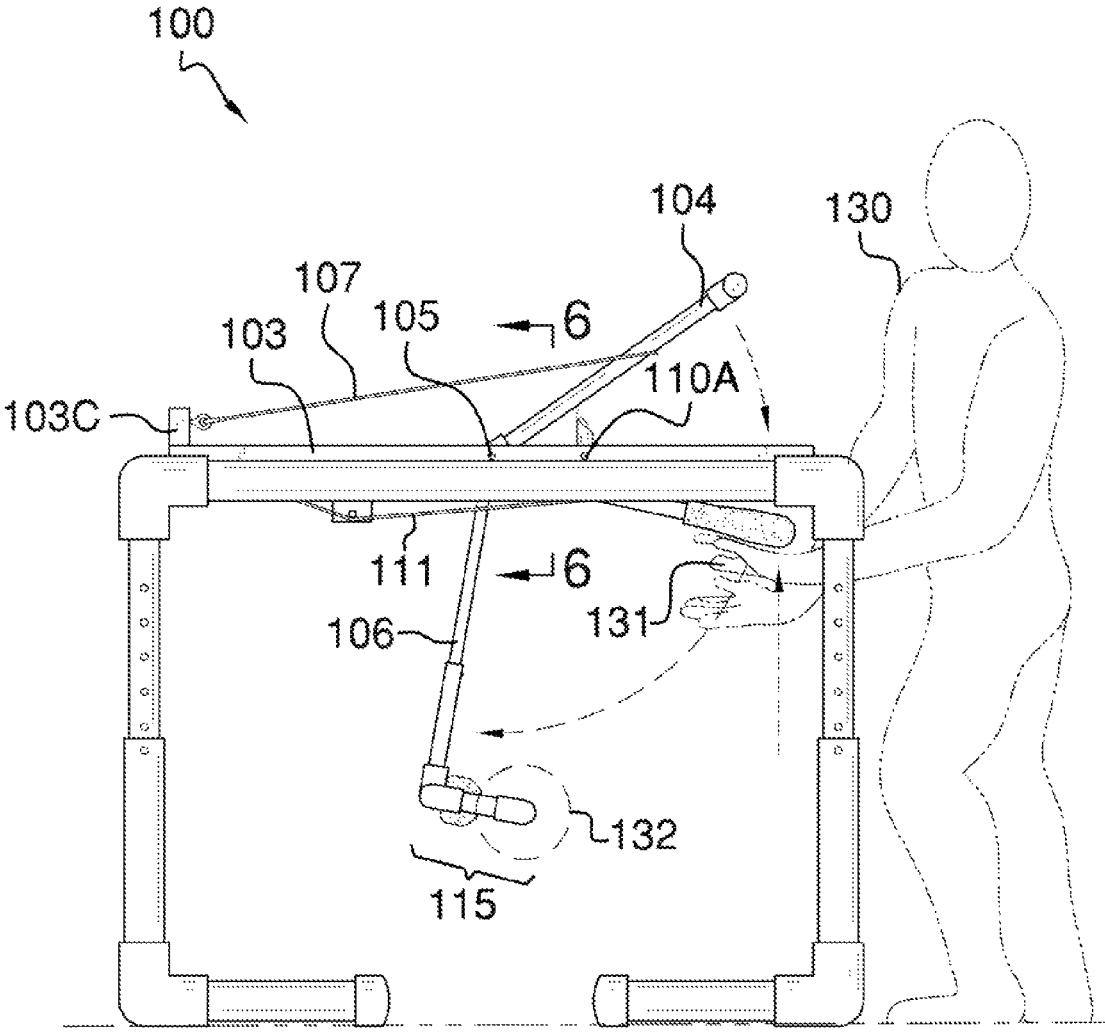
FIG. 4B illustrates a side view of the football snap aid in which an upper rotational arrow indicates rotation of the upper handle down to the locking tab so as to reset the spring-loaded arm there under as depicted by a lower rotational arrow, and wherein and subsequent thereof an upward arrow indicates upward movement of the padded release lever, which in turn releases the spring-loaded arm.
Figure 5:
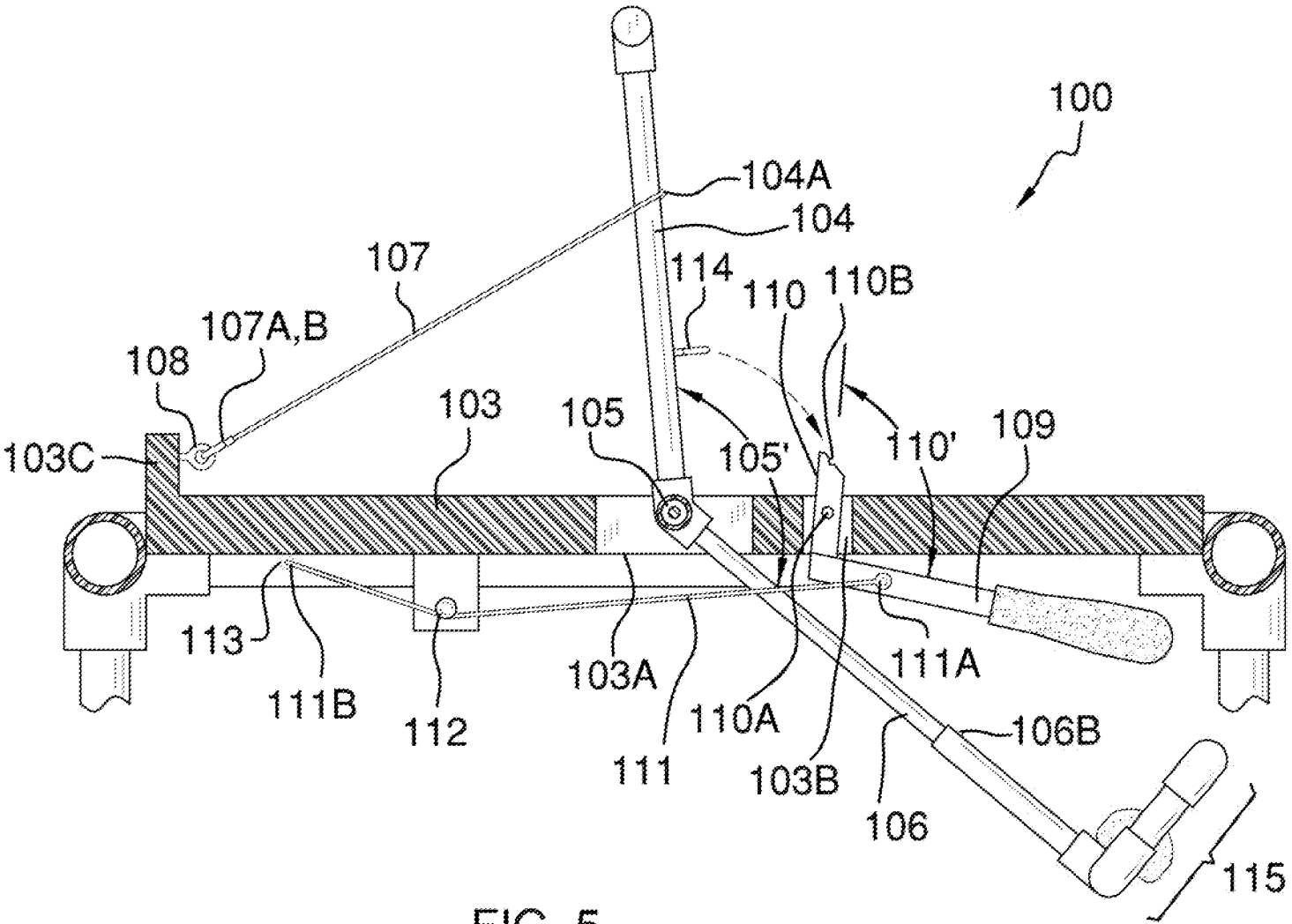
FIG. 5 illustrates a cross-sectional view of the football snap aid along line 5-5 in FIG. 3, and details the tension cords of both the upper handle as well as the padded release lever, and a rotational arrow indicates alignment of a hook on the upper handle when engaging the locking tab that extends from the padded release lever located under the apparatus.
Figure 6:
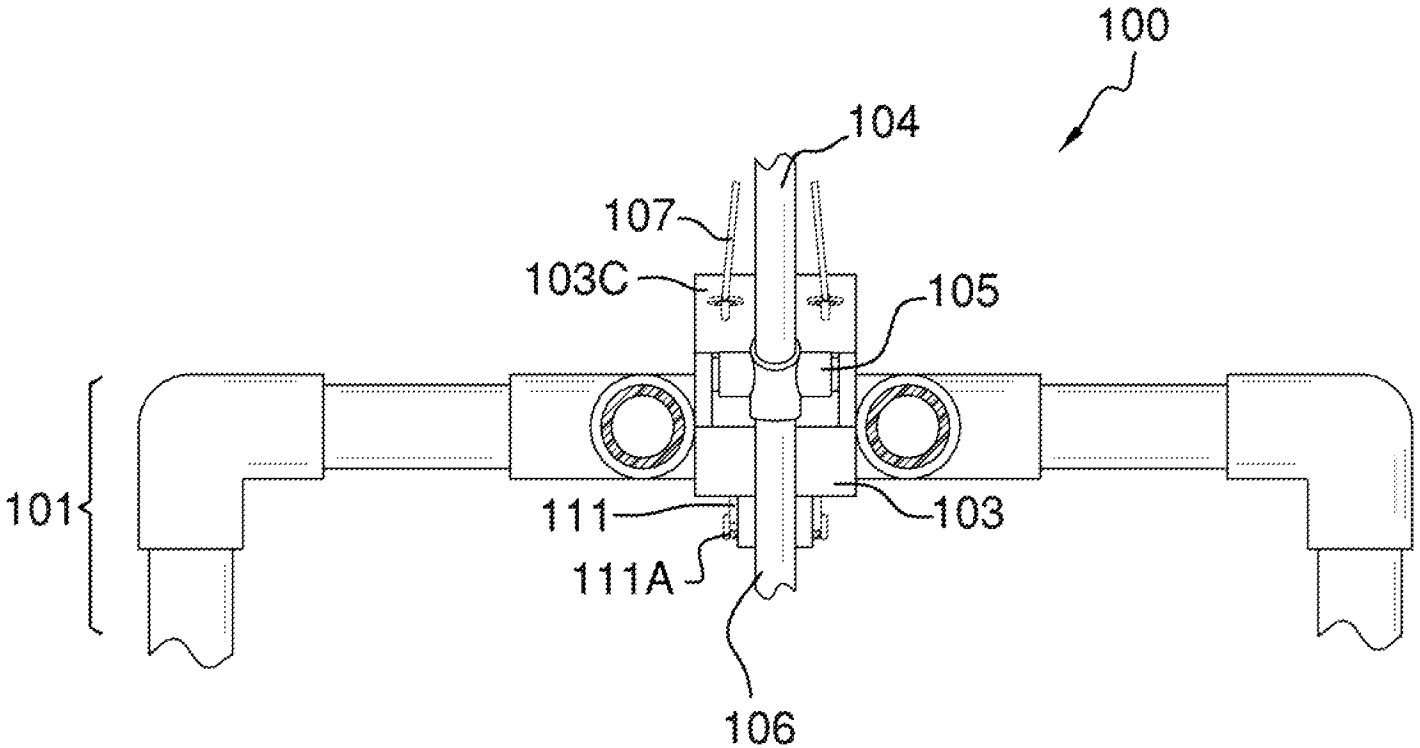
FIG. 6 illustrates a cross-sectional view of the football snap aid along line 6-6 in FIG. 4B, and detailing the pivot point from which the upper handle and the spring-loaded arm rotate as well as the tension cords of the upper handle extending to the rear of the apparatus.

Referring to FIG. 5, the upper handle 104 features a loop 104A through which the first tension cord 107 is threaded through so as to prevent the first tension cord 107 from sliding down there from. The upper handle 104 features a T-handle 104B atop said upper handle 104, and is grasped by an end user when setting the spring-loaded arm 106 down to a lowered position (see FIG. 4B).

The invention 100 includes a padded release lever 109 that includes a locking tab 110 that forms an angle 110' there between. The angle 110' formed between the locking tab 110 and the padded release lever 109 is fixed, and does not change. The locking tab 110 rotates about a pivot point 110A that is situated within the second opening 103B located in the cross brace 103.

The padded release lever 109 is situated beneath the cross brace 103, and is attached to a second tension cord 111. The second tension cord 111 traverses underneath the cross brace 103 from the padded release lever 109 under a pulley 112. The second tension cord 111 attaches at a first end 111A to the padded release lever 109 and attaches at a second end 111B to an eyelet 113 located on the bottom of the cross brace 103 near the rear end of the apparatus 101. The pulley 112 ensures that the second tension cord 111 forms an angle with respect to the padded release lever 109, and that positive tension is applied to the second tension cord 111.

It shall be noted that the first tension cord 107 works independent of the second tension cord 111, and that both cords provide tensioning force onto individual components of the invention 100.

Figure 4A:
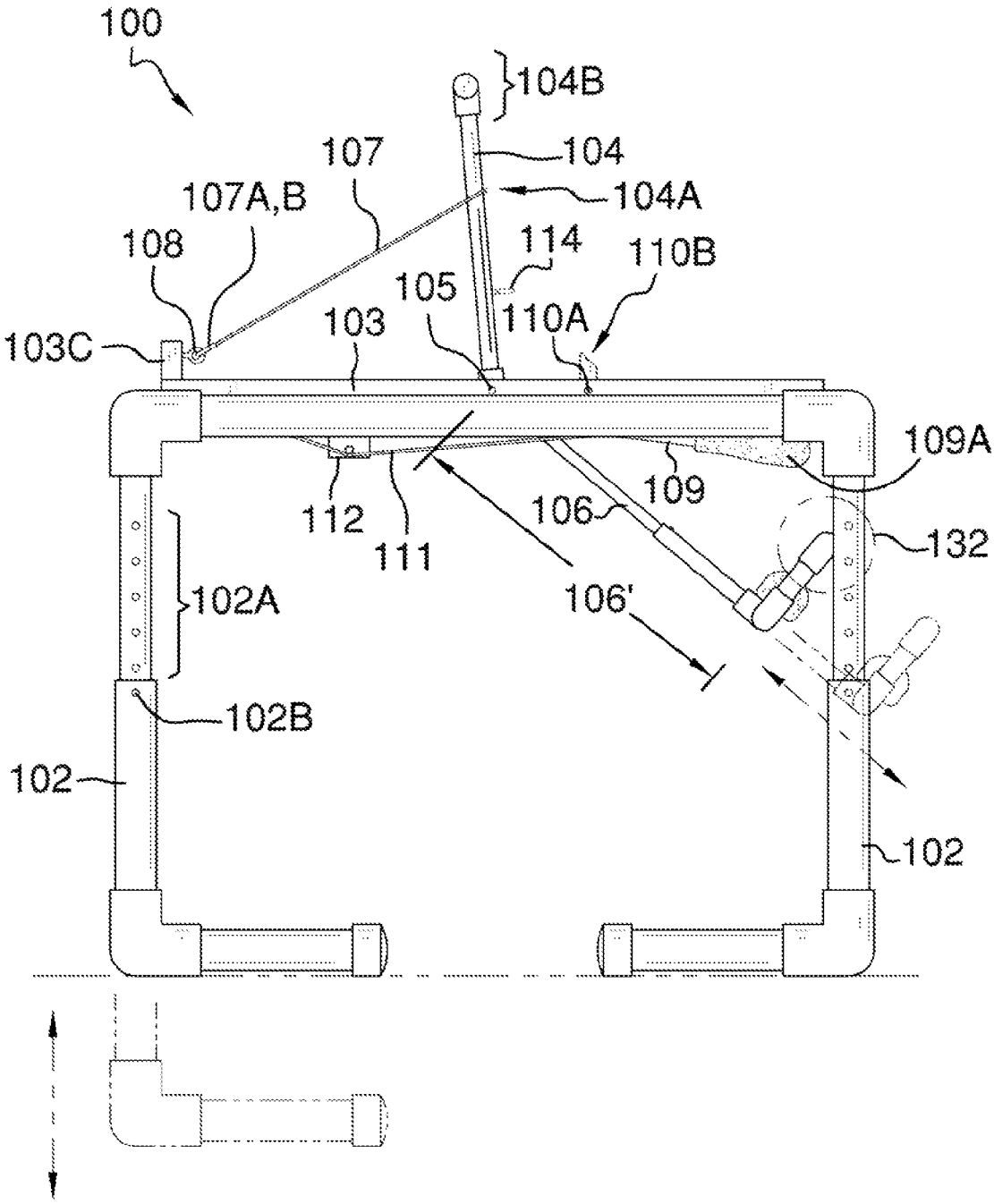
FIG. 4A illustrates a side view of the football snap aid in which one of the adjustable legs is extendable and in which the adjustment means of the spring-loaded arm is being extended as depicted by the arrow, and further detailing the tension cords of both the upper handle as well as the padded release lever.

The upper handle 104 features a lock eyelet 114 that engages a notch 110B located on the locking tab 110. When the padded release lever 109 is in a lowered position (see FIG. 5), the upper handle 104 may be rotated forward in order for the lock eyelet 114 to engage the notch 110B of the locking tab 110 thereby locking the spring-loaded arm 106 in a lowered position (see FIG. 4B). It shall be noted that the padded release lever 109 has a padded end 109A that is driven upward when engaged by a backside of a hand 131 of an end user 130. Upon upward movement of the padded release lever 109, the locking tab 110 rotates and releases the lock eyelet 114 whereby both the upper handle 104 and the spring-loaded arm 106 rotate from a lowered position (as depicted in FIG. 4B) to the hiked position (as depicted in FIG. 4A).

The second tension cord 111 draws the padded lever release 109 down, which in turn draws the locking tab 110 forward.

The spring-loaded arm 106 features adjustment means 106A that enable an overall length 106' of the spring-loaded arm 106 to adjust in order to accommodate differently sized end users 130. The adjustment means 106A simply uses a spring-loaded button 106B that slides into one of a plurality of holes 106C located on the spring-loaded arm 106.

The spring loaded arm 106 includes a football cradle 115 that is composed of a ball pad 115A centered between two arms 115B that are spaced to form a football gap 115' into which a football 132 may be placed therein. The cradle 115 can support the football 132 from the lowered position (see FIG. 4B) to the hiked position (see FIG. 4A). More the point, the football 132 is securedly engaged within the cradle 115 such that the football 132 does not become freed upon sudden movement and subsequent stop of the cradle 115 when moved along the translational movement of the spring-loaded arm 106. The two arms 115B grasp each end of the football 132 while the ball pad 115A supports a side of the football 132 thereon.

The legs 102 are adjustable in height as is the adjustment means 106A of the spring-loaded arm 106. The legs 102 include holes 102A and a spring-loaded button 102B that engages one of the holes 102A such that the elevation of the apparatus 101 can be adjusted to accommodate differently sized end users 130.

The legs 102, the apparatus 101, the spring-loaded arm 106, the upper handle 104, the padded release lever 109, and the cradle 115 may be made of a lightweight material, and is ideally suited for use with polyvinylchloride piping (PVC).

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A football snap aid comprising:

an apparatus onto which an upper handle rotates to extend a spring-loaded arm suspended beneath said apparatus;

wherein a first tension cord applies a tensioning force upon the upper handle so as to move the spring-loaded arm from a lowered position to a hiked position upon movement of a padded release lever that is also located under said apparatus;

wherein the padded release lever is connected to a locking tab that engages the upper handle, and upon upward movement of the padded release lever, the spring-loaded arm is released and moves from the lowered position to the hiked position;

wherein a second tension cord pulls upon the padded release lever.

2. The football snap aid as described in claim 1 wherein the apparatus includes a plurality of legs that extend down to support the apparatus.

3. The football snap aid as described in claim 2 wherein the legs are adjustable and each include a spring-loaded button that engages one of a plurality of holes located thereon.

4. The football snap aid as described in claim 3 wherein the sprig-loaded arm includes a football cradle that supports a football from a lowered position through to the hiked position.

5. The football snap aid as described in claim 4 wherein the football cradle includes a ball pad centered between two arms that are spaced to form a football gap into which the football is placed.

6. The football snap aid as described in claim 5 wherein the two arms each grasp each end of the football whereas the ball pad supports a side of the football thereon.

7. The football snap aid as described in claim 6 wherein the apparatus includes a cross brace that has a first opening and a second opening; wherein a pivot point is located in the first opening; wherein the pivot point is situated between the upper handle and the spring-loaded arm.

8. The football snap aid as described in claim 7 wherein the spring-loaded arm forms an angle with respect to the upper handle.

9. The football snap aid as described in claim 8 wherein the cross brace includes a lip, which is located to a rear of the apparatus; wherein the first tension cord is further defined by a first end attaches via an eyelet to the lip, thereafter wrapping around the upper handle before tying a second end via a second eyelet to the lip.

10. The football snap aid as described in claim 9 wherein the upper handle features a loop through which the first tension cord is threaded through so as to prevent the first tension cord from sliding down there from.

11. The football snap aid as described in claim 10 wherein the upper handle features a T-handle atop said upper handle, and is grasped by an end user when setting the spring-loaded arm down to a lowered position.

12. The football snap aid as described in claim 10 wherein the padded release lever is situated beneath the cross brace, and is attached to the second tension cord; wherein the second tension cord traverses underneath the cross brace from the padded release lever under a pulley; wherein the second tension cord attaches at a first end to the padded release lever and attaches at a second end to an eyelet located on the bottom of the cross brace.

13. The football snap aid as described in claim 12 where upon the upper handle is rotated forward in order for a look eyelet located on the upper handle to engage a notch located on the locking tab thereby locking the spring-loaded arm in a lowered position; where upon upward movement of the padded release lever, the locking tab rotates and releases the lock eyelet whereby both the upper handle and the spring-loaded arm rotate from the lowered position to the hiked position.

14. The football snap aid as described in claim 6 wherein the spring-loaded arm features adjustment means situated next to the cradle, and adjusts an overall length of the spring-loaded arm.

15. A football snap aid comprising:

an apparatus onto which an upper handle rotates to extend a spring-loaded arm suspended beneath said apparatus;

wherein a first tension cord applies a tensioning force upon the upper handle so as to move the spring-loaded arm from a lowered position to a hiked position upon movement of a padded release lever that is also located under said apparatus;

wherein the padded release lever is connected to a locking tab that engages the upper handle, and upon upward movement of the padded release lever, the spring-loaded arm is released and moves from the lowered position to the hiked position;

wherein the spring-loaded arm includes a football cradle that supports a football from a lowered position through to the hiked position;

wherein the apparatus includes a cross brace that has a first opening and a second opening; wherein a pivot point is located in the first opening; wherein the pivot point is situated between the upper handle and the spring-loaded arm;

wherein the spring-loaded arm forms an angle with respect to the upper handle;

wherein a second tension cord pulls upon the padded release lever;

a plurality of legs that extend down to support the apparatus.

16. The football snap aid as described in claim 15 wherein the legs are adjustable and each include a spring-loaded button that engages one of a plurality of holes located thereon.

17. The football snap aid as described in claim 15 wherein the football cradle includes a ball pad centered between two arms that are spaced to form a football gap into which the football is placed; wherein the two arms each grasp each end of the football whereas the ball pad supports a side of the football thereon.

18. The football snap aid as described in claim 15 wherein the cross brace includes a lip, which is located to a rear of the apparatus; wherein the first tension cord is further defined by a first end attaches via an eyelet to the lip, thereafter wrapping around the upper handle before tying a second end via a second eyelet to the lip; wherein the upper handle features a loop through which the first tension cord is threaded through so as to prevent the first tension cord from sliding down there from; wherein the upper handle features a T-handle atop said upper handle, and is grasped by an end user when setting the spring-loaded arm down to a lowered position.

19. The football snap aid as described in claim 18 wherein the padded release lever is situated beneath the cross brace, and is attached to the second tension cord; wherein the second tension cord traverses underneath the cross brace from the padded release lever under a pulley; wherein the second tension cord attaches at a first end to the padded release lever and attaches at a second end to an eyelet located on the bottom of the cross brace; where upon the upper handle is rotated forward in order for a lock eyelet located on the upper handle to engage a notch located on the locking tab thereby locking the spring-loaded arm in a lowered position; where upon upward movement of the padded release lever, the locking tab rotates and releases the lock eyelet whereby both the upper handle and the spring-loaded arm rotate from the lowered position to the hiked position.

20. The football snap aid as described in claim 19 wherein the spring-loaded arm features adjustment means situated next to the cradle, and adjusts an overall length of the spring-loaded arm.

* * * * *